US009650885B2

(12) United States Patent
Ringgenberg et al.

(10) Patent No.: US 9,650,885 B2
(45) Date of Patent: May 16, 2017

(54) SUBSEA DUMMY RUN ELIMINATION ASSEMBLY AND RELATED METHOD

(71) Applicant: Halliburton Energy Services, Inc., Houston, TX (US)

(72) Inventors: Paul David Ringgenberg, Frisco, TX (US); Dalmo Massaru Wakabayashi, Dallas, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/426,957

(22) PCT Filed: Sep. 19, 2012

(86) PCT No.: PCT/US2012/056047
§ 371 (c)(1),
(2) Date: Mar. 9, 2015

(87) PCT Pub. No.: WO2014/046651
PCT Pub. Date: Mar. 27, 2014

(65) Prior Publication Data

US 2015/0226055 A1 Aug. 13, 2015

(51) Int. Cl.
*E21B 47/09* (2012.01)
*E21B 47/00* (2012.01)
(Continued)

(52) U.S. Cl.
CPC ..... *E21B 47/09* (2013.01); *E21B 19/10* (2013.01); *E21B 33/038* (2013.01); *E21B 33/06* (2013.01);
(Continued)

(58) Field of Classification Search
CPC ..... E21B 19/10; E21B 33/038; E21B 33/06; E21B 33/064; E21B 47/0001; E21B 47/04; E21B 47/09; E21B 49/008
(Continued)

(56) References Cited

U.S. PATENT DOCUMENTS 4,010,804 A * 3/1977 Garcia ..... E21B 43/10 166/208
4,116,272 A * 9/1978 Barrington ..... E21B 33/064 166/321

(Continued)

OTHER PUBLICATIONS

International Preliminary Report on Patentability, Mar. 24, 2015, PCT/US2012/056047, 11 pages, International Searching Authority, US.

(Continued)

*Primary Examiner* — James G Sayre
(74) *Attorney, Agent, or Firm* — Haynes and Boone, LLP

(57) ABSTRACT

A system and method to determine and adjust positioning of a subsea test tree ("SSTT") within a blowout preventer ("BOP"), the system including an SSTT, at least one sensing mechanisms to detect the position of one or more BOP rams and a fluted hanger. Once the assembly is deployed, the ram positions are detected and the position of the fluted hanger is adjusted while deployed to accordingly adjust the spacing between the SSTT and the fluted hanger, thereby eliminating the need of a dummy run. Another system and method improves a dummy run by providing a lightweight joint and dummy hanger deployed on a line (e.g., wireline, slickline, etc.). Through the use of a line and the lightweight of the joint and dummy hanger, the dummy run operation is conducted quickly and efficiently.

39 Claims, 7 Drawing Sheets

(51) Int. Cl.

| | |
|---|---|
| ***E21B 19/10*** | (2006.01) |
| ***E21B 33/064*** | (2006.01) |
| ***E21B 33/038*** | (2006.01) |
| ***E21B 33/06*** | (2006.01) |
| ***E21B 47/04*** | (2012.01) |
| ***E21B 49/00*** | (2006.01) |
| ***E21B 34/04*** | (2006.01) |

(52) U.S. Cl.
CPC ..... *E21B 33/064* (2013.01); *E21B 34/045* (2013.01); *E21B 47/0001* (2013.01); *E21B 47/04* (2013.01); *E21B 49/008* (2013.01)

(58) Field of Classification Search
USPC ..... 166/336, 363, 364, 368, 250.01, 255.1, 166/255.2
See application file for complete search history.

(56) References Cited

U.S. PATENT DOCUMENTS 4,731,744 A * 3/1988 Harrell, Jr. ..... G01D 5/34776 33/314
5,320,325 A * 6/1994 Young ..... E21B 33/062 251/1.3
6,758,272 B2 7/2004 Bixenman et al.
7,301,472 B2 * 11/2007 Kyle ..... E21B 47/14 181/103
8,261,837 B2 * 9/2012 Leonard ..... E21B 19/004 166/345
2002/0189806 A1 * 12/2002 Davidson ..... E21B 33/0355 166/250.01
2012/0000646 A1 * 1/2012 Liotta ..... E21B 33/062 166/85.4
2012/0197527 A1 8/2012 McKay et al.
2012/0312529 A1 * 12/2012 Ringgenberg ..... E21B 41/00 166/250.01
2013/0120154 A1 * 5/2013 Gleitman ..... E21B 17/003 340/854.4
2013/0153241 A1 * 6/2013 Mallinson ..... E21B 33/0355 166/363

OTHER PUBLICATIONS

International Search Report and the Written Opinion of the International Searching Authority, or the Declaration, Dec. 17, 2012, PCT/US2012/056047, 13 pages, International Searching Authority, US.
Written Opinion dated Jan. 27, 2016 for Singapore Patent Application No. 11201502134P, 9 pages.

* cited by examiner

SUBSEA DUMMY RUN ELIMINATION ASSEMBLY AND RELATED METHOD

The present application is a U.S. National Stage patent application of International Patent Application No. PCT/US2012/056047, filed on Sep. 19, 2012, the benefit of which is claimed and the disclosure of which is incorporated herein by reference in its entirety.

FIELD OF THE INVENTION

The present invention relates generally to subsea operations and, more specifically, to an assembly and method for eliminating the dummy run utilized to space subsea test equipment within a blow-out preventer ("BOP") and/or to an assembly and method to reduce the time required to conduct a dummy run.

BACKGROUND

During conventional drilling procedures, it is often desirable to conduct various tests of the wellbore and drill string while the drill string is still in the wellbore. These tests are commonly referred to as drill stem tests ("DST"). To facilitate DST, a subsea test tree ("SSTT") carried by the drill string is positioned within the BOP stack. The SSTT is provided with one or more valves that permit the wellbore to be isolated as desired, for the performance of DST. The SSTT also permits the drill string below the SSTT to be disconnected at the seabed, without interfering with the function of the BOP. In this regard, the SSTT serves as a contingency in the event of an emergency that requires disconnection of the drillstring in the wellbore from the surface, such as in the event of severe weather or malfunction of a dynamic positioning system. As such, the SSTT includes a decoupling mechanism to unlatch the portion of the drill string in the wellbore from the drill string above the wellbore. Thereafter, the surface vessel and riser can decouple from the BOP and move to safety. Finally, the SSTT typically is deployed in conjunction with a fluted hanger disposed to land at the top of the wellbore to at least partially support the lower portion of the drillstring during DST.

Before DST, however, proper positioning of the SSTT within the BOP is important so as to prevent the SSTT from interfering with operation of the BOP. In particular, if the SSTT is not correctly spaced apart from the hanger, proper functioning of the BOP rams may be inhibited. Moreover, the SSTT may be destroyed by the rams to the extent the rams are activated for a particular reason. Accordingly, a "dummy run" is conducted before DST to determine positioning of the SSTT within the BOP, and in particular the spacing of the fluted hanger from the SSTT so that the SSTT components are positioned between the BOP rams.

During conventional dummy runs, a temporary hanger with a painted pipe above it is run into the BOP, typically on jointed tubing. Once the temporary hanger lands within the BOP, the rams are closed on the painted pipe with sufficient pressure to leave marks that indicate their position relative to the landed hanger. The rams are then retracted, and the dummy string is retrieved uphole. Based upon the markings on the painted pipe, proper positioning of the SSTT within the BOP is determined and the spacing of the fluted hanger from the SSTT is accordingly adjusted at the surface to achieve the desired positioning when the SSTT is deployed in the BOP.

Although simplistic, there is at least one severe drawback to conventional dummy run operations. Making up the jointed tubing used in the dummy assembly is very time consuming. Given this, and the fact that some wells are drilled at ocean depths of up to 10,000 feet or deeper, it can take days to complete a single dummy run. At the present time, it is estimated that some floating rigs have a daily cost of upwards of 400,000 USD. Therefore, conventional dummy run operations are very expensive.

In view of the foregoing, there is a need in the art for cost-effective approaches to properly positioning of the subsea test equipment within the BOP.

DESCRIPTION OF ILLUSTRATIVE EMBODIMENTS

Illustrative embodiments and related methodologies of the present invention are described below as they might be employed in an apparatus and method for eliminating dummy runs and/or for reducing the time required to conduct dummy runs. In the interest of clarity, not all features of an actual implementation or methodology are described in this specification. Also, the "exemplary" embodiments described herein refer to examples of the present invention. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the invention will become apparent from consideration of the following description and drawings.

Figure 1A:
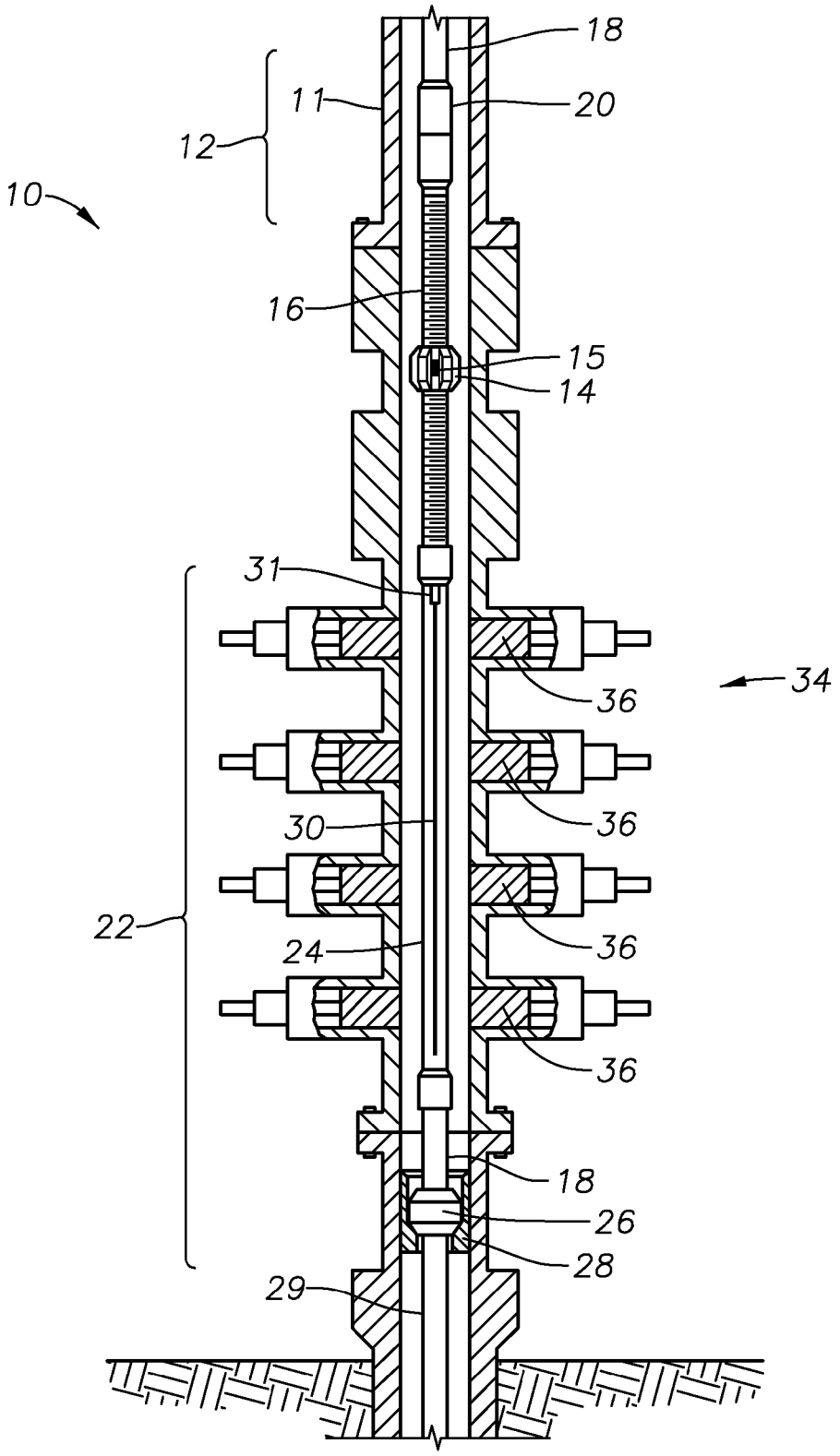
FIGS. 1A and 1B illustrate a dummy run elimination assembly according to an exemplary embodiment of the present invention.

FIG. 1A illustrates an exemplary embodiment of assembly 10 to eliminate the need for a dummy run according to exemplary embodiments of the present invention. Although not shown, assembly 10 is carried on a tubular string 18 which extends down through a body of water from a surface vessel, via a riser 11 connected to BOP 34. Assembly 10 includes a SSTT 12 at its upper end and a temporary hanger system 22 at its lower end. SSTT 12 includes a valve/hydraulic section 20 that comprises one or more valves and may also include hydraulic mechanisms to operate the valves. Although not illustrated for the sake of simplicity, SSTT 12 may contain a variety of other desirable components as would be understood by those ordinarily skilled in the art having the benefit of this disclosure. A fluted hanger 14 is positioned below SSTT 12 along a threaded profile 16 forming part of tubular string 18. Fluted hanger 14 may be an internally threaded collar disposed to engage the threaded profile 16. As will be described below, threaded profile 16 allows adjustment of fluted hanger 14 up or down string 18.

Still referring to the exemplary embodiment of FIG. 1A, extending below fluted hanger 14 is a temporary hanger system 22 comprising a tubular sensing joint 24 at its upper end, and a temporary hanger 26 carried by string 18 beneath sensing joint 24. In certain embodiments, temporary hanger system 22 is approximately 30 feet below fluted hanger 14. However, this distance could be varied as desired. In FIG. 1A, temporary hanger system 22 is illustrated substantially inside BOP 34, with temporary hanger 26 landed inside wear bushing 28 disposed at the top of the wellbore.

Temporary hanger 26 is temporary in that it is adapted to be released such that, when it becomes desirable to lower assembly 10 further into the BOP, temporary hanger 26 can be released or disengaged from its landing, such as, for example, retracting the temporary hanger, thus permitting it to be passed down through wear bushing 28. An exemplary temporary hanger is described in Patent Cooperation Treaty Application No. PCT/US2011/039841, entitled "REDUCING TRIPS IN WELL OPERATIONS," filed on Jun. 9, 20011, also owned by the Assignee of the present invention, Halliburton Energy Services Inc. of Houston, Tex., which is hereby incorporated by reference in its entirety. A drill string section 29 extends down below temporary hanger 26, as would be understood by those ordinarily skilled in the art having the benefit of this disclosure.

In this exemplary embodiment, sensing joint 24 is a tubular member having a length sufficient to extend from the upper most BOP ram 36 to the lower most BOP ram 36. However, a shorter sensing joint may also be utilized. Sensing joint 24 includes a distributed sensing module 30 which extends along the length of sensing joint 24. A CPU 31, along with necessary processing/storage/communication circuitry, forms part of sensing joint 24 and is coupled to sensing module 30 in order to process measurement data and communicate that data back uphole and/or to other assembly components. In the alternative, however, CPU 31 may be located remotely from sensing joint 24, as would be understood by one ordinarily skilled in the art having the benefit of this disclosure.

Sensing module 30 is coupled to the inner bore of sensing joint 24. In the alternative, however, sensing module 30 may be integrated into the wall of sensing joint 24, or applied in some other suitable manner. As will be described below, distributed sensing module 30 senses the location of each of the individual BOP rams 36 when they are closed against sensing joint 24, thereby determining the distance between each BOP ram 36 and temporary hanger 26. This measurement data is then processed by CPU 31 and utilized to perform an adjustment, if necessary, of fluted hanger 14. During adjustment operations, CPU 31 (or some remote system) utilizes sensor 15 coupled to fluted hanger 14 in order to monitor the position of fluted hanger 14 on threaded profile 16.

A variety of sensors and sensing methodologies may be utilized in conjunction with sensing joint 24 and sensors 15, 30 as would be understood by one ordinarily skilled in the art having the benefit of this disclosure. The sensors could take the form of an acoustic (sonic or ultrasonic), capacitance, thermal, pressure, vibration, density, magnetic, inductive, dielectric, visual, nuclear or some other suitable sensor. Instead of the distributed sensing module described herein, however, one or more sensors may be individually placed along sensing joint 24. As such, in a most simplistic approach, sensing joint 24 may simply detect that a BOP ram 36 has contacted, or come into close proximity to, sensing joint 24. Yet, in a more sophisticated embodiment, sensing joint 24 would detect the location of each individual BOP ram 36 along sensing joint 24.

Figure 1B:
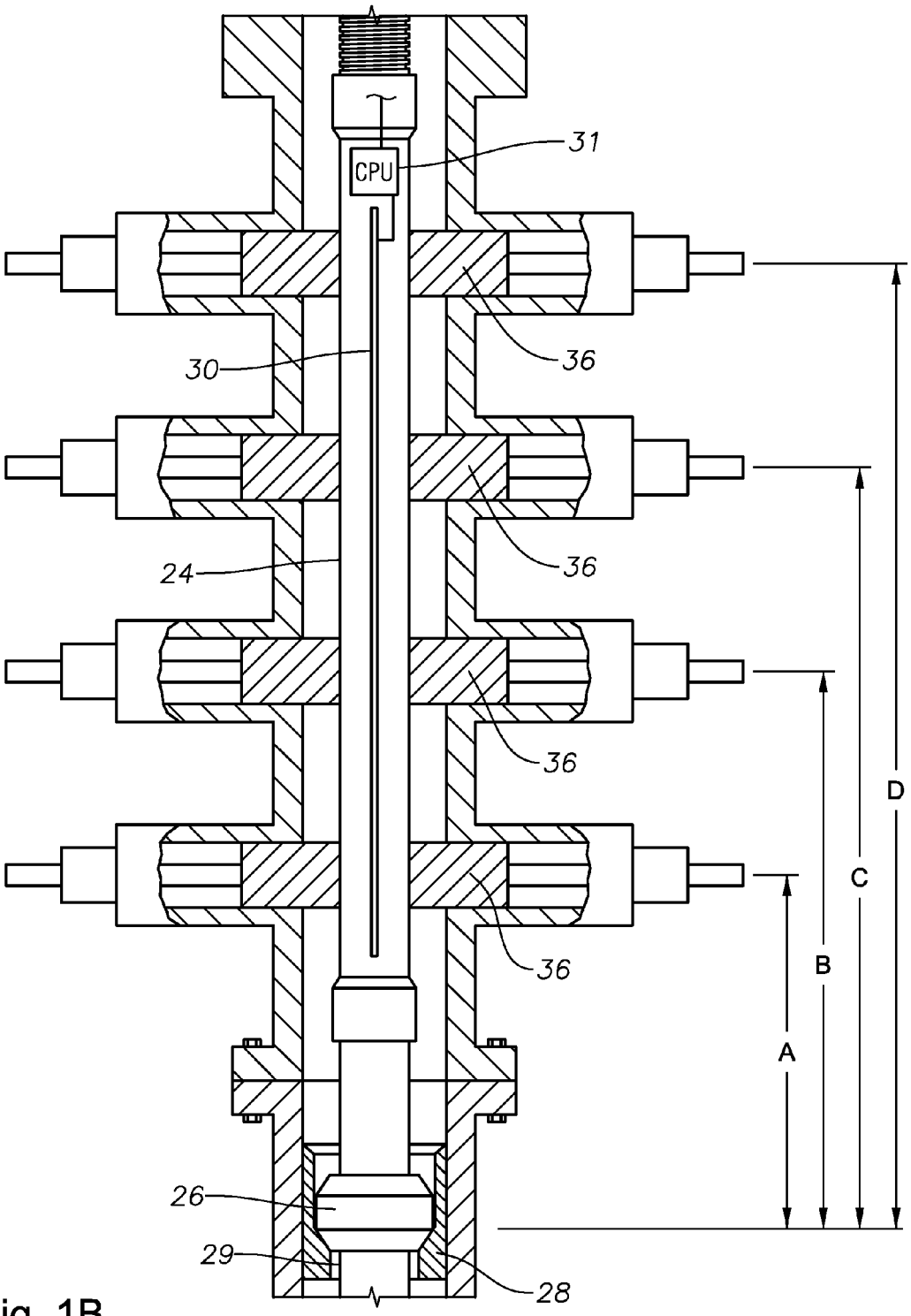

Referring to FIG. 1B, once one or more BOP rams 36 are closed against or around sensing joint 24, or come into close enough proximity to joint 24 to trigger sensing module 30, CPU 31 processes the resulting measurement data to determine if adjustment of fluted hanger 14 on threaded profile 16 is necessary. As shown, CPU 31 determines the distances A, B, C, D that correlate to each BOP ram 36. Thereafter, the CPU 31 transmits one or more signals representing the measurement data to the necessary system components to initiate adjustment of fluted hanger 14. In addition, the adjustment may be based on one or more of the measurements A-D.

During the adjustment process, the position of fluted hanger 14 is monitored via sensor 15. In one exemplary embodiment, the measurement data is transmitted to the surface via telemetry. Thereafter, it is determined whether an adjustment of fluted hanger 14 is necessary and, if so, adjustment is initiated. This determination may be made using computerized or manual processes, as described herein. Exemplary telemetry systems include electric wire, acoustic signal, pressure pulse, electromagnetic signals, etc. In another exemplary embodiment, the CPU 31 determines whether an adjustment is necessary and, if so, transmits the necessary adjustment signals to actuate downhole motors, or some other mechanism, which then adjusts fluted hanger 14 automatically. Accordingly, those ordinarily skilled in the art having the benefit of this disclosure realize there are a variety of ways in which to achieve adjustment of fluted hanger 14.

Figure 2A:
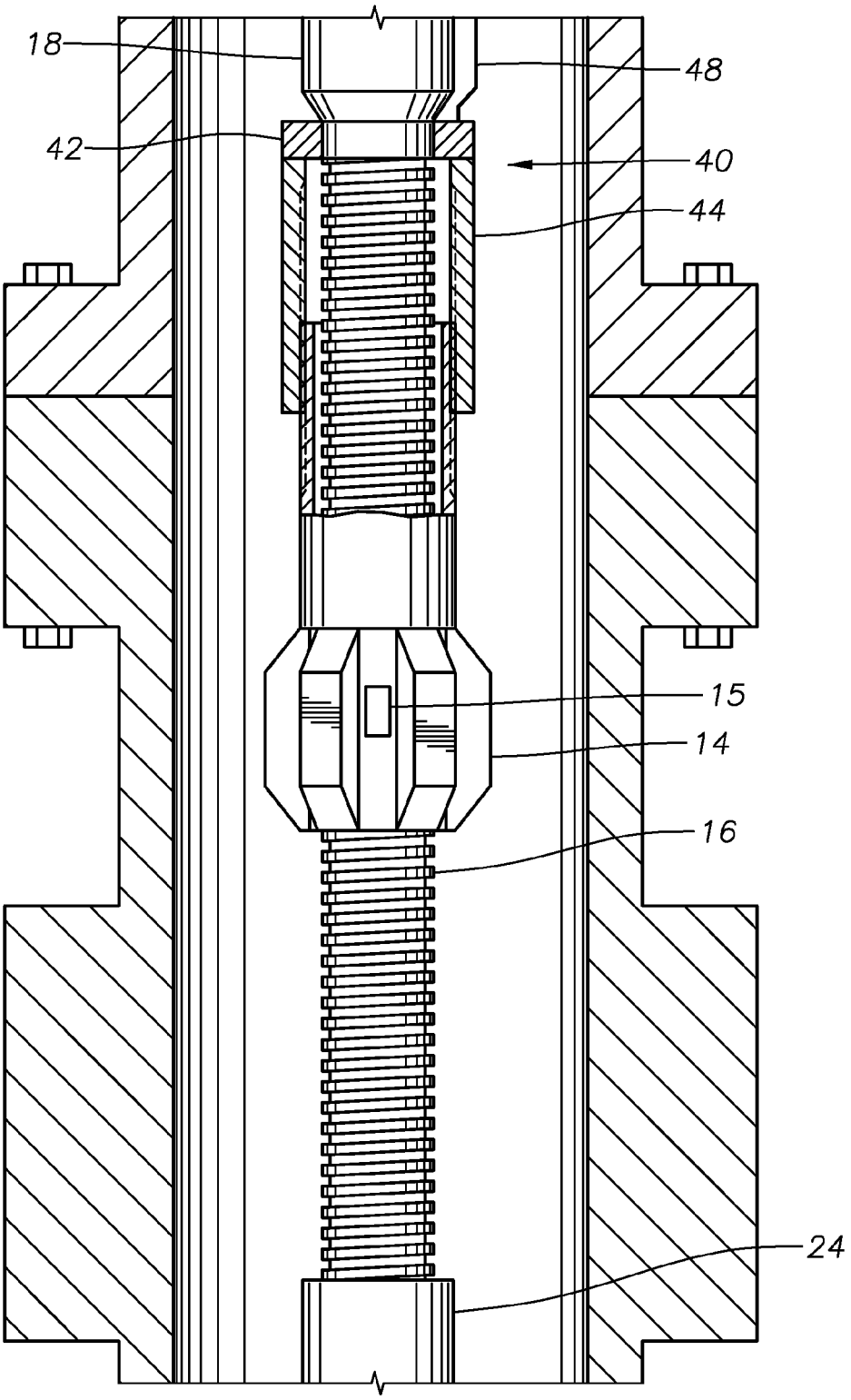
FIGS. 2A and 2B illustrate exploded views of hanger adjustment mechanisms according to exemplary embodiments of the present invention.

Exemplary adjustment methodologies will now be described. In a first exemplary embodiment as shown in FIG. 2A, a sectional side view of assembly 10 is illustrated in which a motor 40 is coupled to string 18 above fluted hanger 14. Motor 40 includes a body member 42 attached to string 18, having a splined telescoping extension 44 extending from member 42. The lower end of splined telescoping extension 44 is attached to fluted hanger 14. A hydraulic or electric line 40 is connected to body member 42 in order to actuate motor 48 in a clockwise or counter-clockwise direction around string 18. Line 48 may be coupled to the umbilical assembly of SSTT 12, thereby providing surface communication. In the alternative, however, motor 40 may be powered by a local power source (not shown), such as a battery. Nevertheless, when adjustment of fluted hanger 14 is desired, body member 42 is rotated, which then rotates splined telescoping extension 44, thereby rotating fluted hanger 14 as desired. As fluted hanger 14 is rotated, it moves closer to or further away from motor 40. To keep rotational connection with fluted hanger 14, telescoping extension 44 allows for this up and down movement, as would be readily appreciated by those ordinarily skilled in the art having the benefit of this disclosure. Moreover, although motor 40 is described as being coupled above fluted hanger 14, those ordinarily skilled in the art having the benefit of this disclosure also realize it may be coupled beneath fluted hanger 14.

Figure 2B:
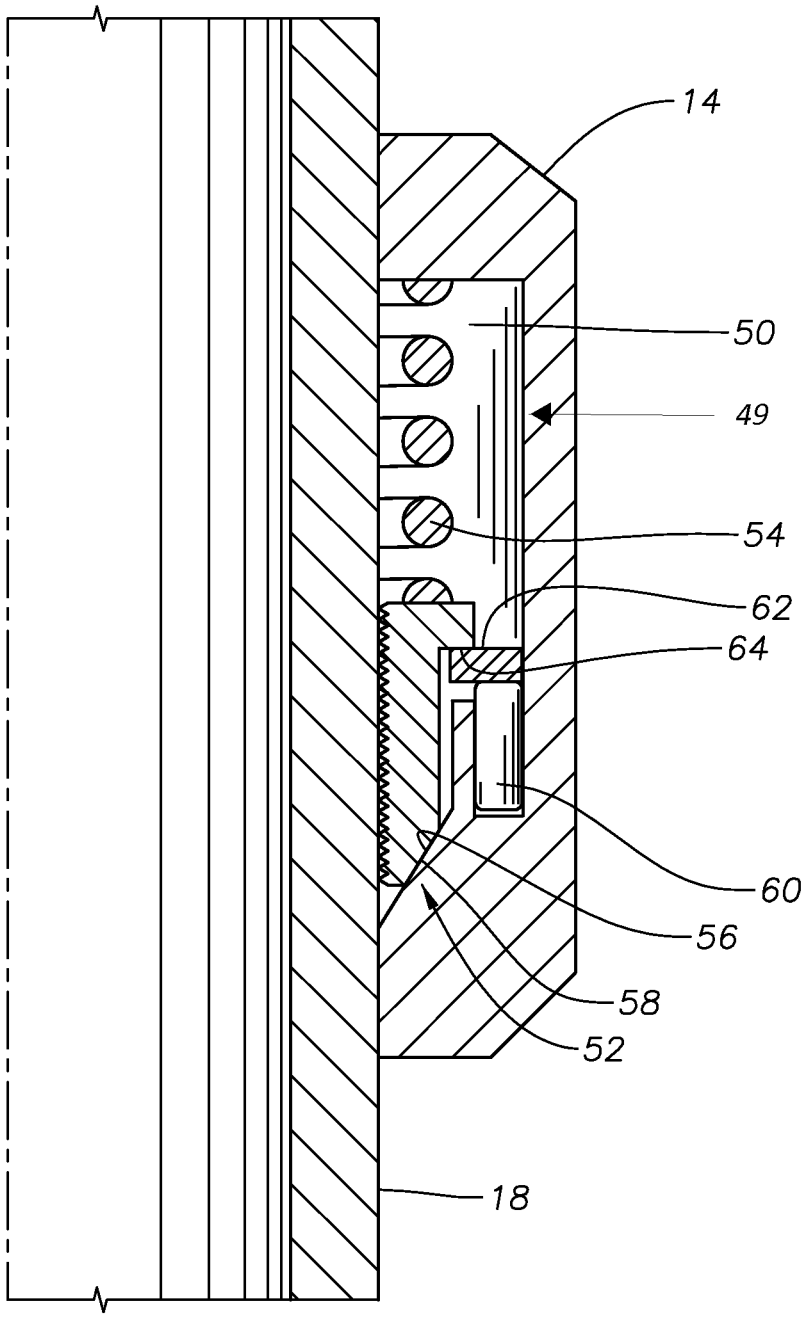

FIG. 2B illustrates yet another exemplary adjustment mechanism of the present invention. Here, fluted hanger 14 is shown positioned around string 18. Also, note that threaded profile 16 is not utilized in this embodiment. Rather, fluted hanger 14 includes a slip mechanism 49 disposed to engage string 18. In certain preferred embodiments, slip mechanism 49 includes a chamber 50 disposed on an internal surface of the collar forming hanger 14. A spring 54 is disposed within chamber 50, preferably extending from its upper end. At the bottom of spring 54 is a wedge 52 having an angled profile 58 that interacts with an angled profile 56 of fluted hanger 14. A deactivation piston 60, or solenoid, is positioned inside chamber 50 which deactivates wedge 52. Piston 60 is coupled to a fluid line (not shown), such as a hydraulic line, extending from the umbilical assembly of SSTT 12. In operation, the force of spring 54 acting on wedge 52 causes wedge 52 to slide down angled profile 56, where the teeth of wedge 52 bite into string 18, thus securing fluted hanger 14 in position. When adjustment is desired, piston 60 is activated, which in turn forces member 62 up against shoulder 64 of wedge 52, forcing wedge 52 up and compressing spring 54. As such, the teeth of wedge 52 release string 18, and string 18 can be moved up or down from the surface as desired.

A variety of other adjustment may also be utilized. For example, fluted hanger 14 may be temporarily positioned inside the annular BOP rams positioned above BOP rams 36. Thereafter, the annular rams are closed around fluted hanger 14 to hold it in place, and string 18 is rotated at the surface. As such, fluted hanger 14 will be adjusted up or down threaded profile 16 until the desired distance between it and SSTT 12 is achieved. During this procedure, CPU 31 or some other remote system may be utilized to monitor the location of hanger 14 using sensor 15 to determine when the desired positioning has been achieved.

In yet another exemplary methodology, drag blocks may be installed on the bottom portion of fluted hanger 14 and rotation of string 18 may be used to raise or lower fluted hanger 14 to the correct position. In embodiments where threaded profile 16 is not utilized, such as is described above, drag blocks may be installed on the bottom portion of fluted hanger 14 and string 18 can be raised or lowered until the desired position of hanger 14 was achieved. Thereafter, a lock may be used to secure fluted hanger 14.

Accordingly, those ordinarily skilled in the art realize there are a variety of adjustment mechanisms that could be utilized with the present invention. In addition, all the adjustment mechanisms described herein may respond to surface commands or autonomously using the measurement data from sensing joint 24.

Referring to FIGS. 1A and 1B, an exemplary operation utilizing embodiments of the present invention will now be described. When it is necessary to conduct a DST, assembly 10 is deployed from a surface vessel, down through riser 11, and into BOP 34. Assembly 10 continues to be lowered until temporary hanger 26 lands on wear bushing 28. Once landed, one or more of BOP rams 36 are closed on, around or adjacent to sensing joint 24 at a pressure sufficient to trigger sensor module 30, but not to damage sensing joint 24. Thereafter, sensing module 30 detects the position of BOP rams 36 along joint 24 and, hence, the distances A-D between each BOP ram 36 and temporary hanger 26.

During the design phase of the DST operation, the position of the BOP rams 36 along SSTT 12 is predicted in accordance with design specifications for the BOP and wellhead. Based upon this, the distance between SSTT 12 and fluted hanger 14 is then predicted (referred to herein as the "predicted distance"). In one exemplary embodiment, fluted hanger 14 is positioned a distance below SSTT 12 based upon the predicted distance before assembly 10 is deployed. However, in the alternative, fluted hanger 14 may simply be positioned randomly along threaded profile 14, and adjusted later. If the latter approach is adopted, the random position would be measured and utilized as the predicted position. Nevertheless, after the true position of BOP rams 36 is determined (via distances A-D) using temporary hanger system 22 (referred to as "true distance"), CPU 31 compares the predicted distance to the true distance, and, if necessary, transmits signals necessary to adjust fluted hanger 14 up or down threaded profile 16 such that the position of SSTT 12 corresponds to the true position of BOP rams 36.

Thereafter, BOP rams 36 are retracted from sensing joint 24. The measurement data is then utilized by CPU 31 to perform an adjustment, if necessary, of fluted hanger 14 up or down threaded profile 16 (or otherwise, up or down string 18 when no threaded profile 16 is present). As previously described, the measurement analysis and/or fluted hanger adjustment processes can be conducted downhole without any surface intervention. However, in the alternative, one or more of the analysis or adjustment processes may be conducted with uphole intervention utilizing a remote CPU or adjustment system.

Temporary hanger 26 is then retracted such that it can be passed down through wear bushing 28 and into the wellbore as string 18 is lowered. As previously described, once temporary hanger 26 is retracted, its diameter is small enough to allow fluid flow around it, thus permitting DST to be conducted. String 18 continues to be lowered as sensing joint 24 also passes down through wear bushing 28, until fluted hanger 14 lands on wear bushing 26. Thereafter, DST can be conducted as desired. Moreover, SSTT 12 is properly positioned within BOP 34 such that BOP rams 36 can be activated without damaging the rams 36 or the SSTT 12.

Figure 3:
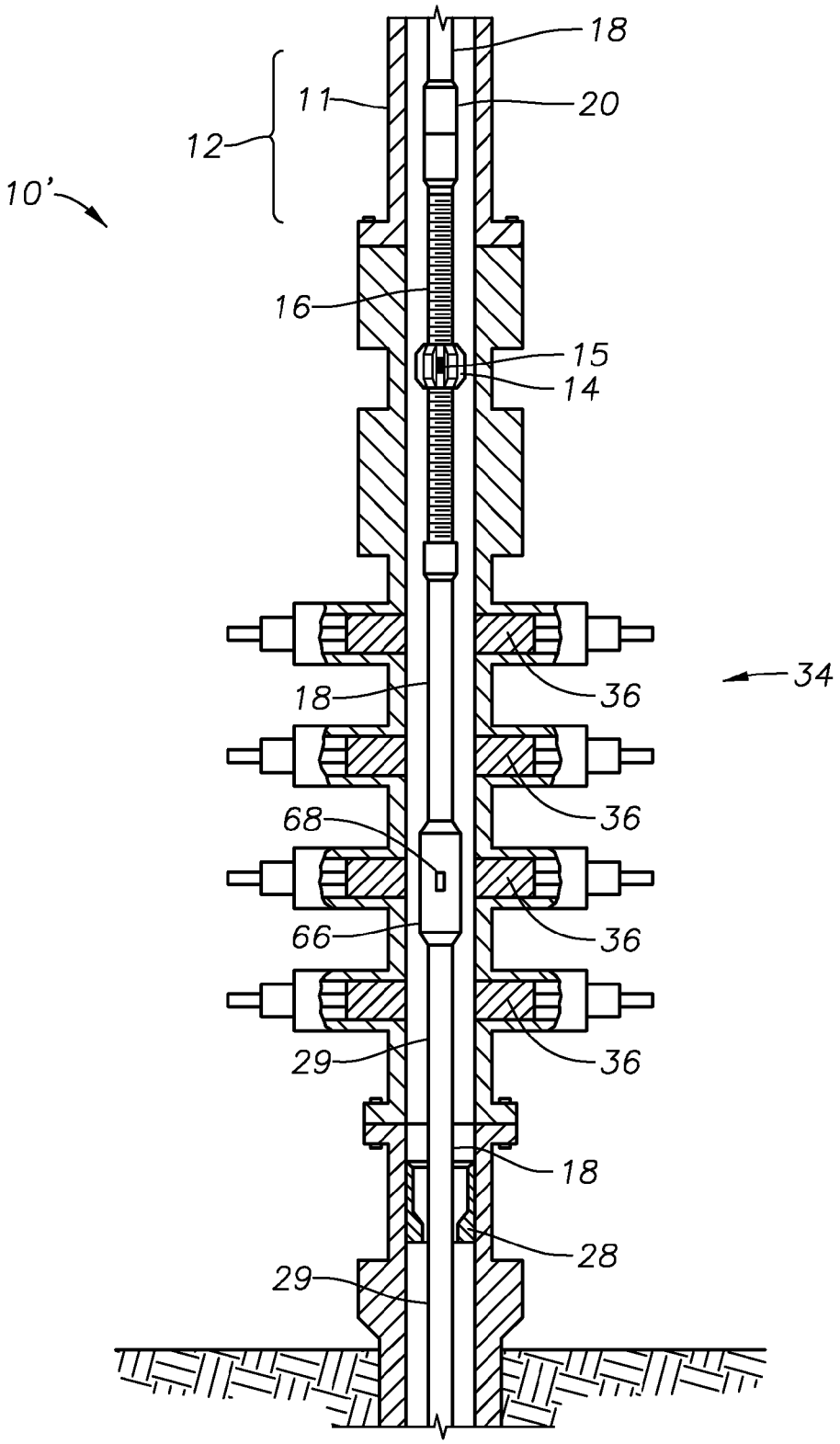
FIGS. 3-5 illustrate various alternative assemblies according to exemplary embodiments of the present invention.

FIG. 3 illustrates yet another exemplary embodiment of the present invention. Here, assembly 10' is similar to previous embodiments of assembly 10. However, instead of temporary hanger system 22, a logging tool 66 is positioned beneath adjustable hanger 14. Logging tool 66 also includes a sensor 68 which senses the position of BOP rams 36 and wear bushing 28. Although not shown, a CPU, along with necessary processing/storage/communication circuitry, forms part of logging tool 66 and is coupled to sensor 68 in order to process measurement data and communicate that data back uphole and/or to other assembly components. In the alternative, however, the CPU may be located remotely from logging tool 66, as would be understood by one ordinarily skilled in the art having the benefit of this disclosure. Sensor 68 could take on a variety of forms such as, for example, acoustic (sonic or ultrasonic), capacitance, thermal, density, magnetic, inductive, dielectric, visual or nuclear, and may communicate in real-time.

An exemplary operation utilizing the embodiment of FIG. 3 will now be described. As assembly 10' is deployed into BOP 34 logging tool 66 passes through BOP 34 and sensors 68 detect the position of one or more of BOP rams 36. The data is then logged by the CPU located on-board or remotely from logging tool 66, and then stored accordingly. As assembly 10' continues to lower into BOP 34, logging tool 66 will pass through the hang off/landing location (e.g., wear bushing 28) where it again detects and logs the position of the hang off location. Those ordinarily skilled in the art having the benefit of this disclosure realize there are a variety of methodologies in which to log the position and depth of the BOP and wear bushing utilizing logging instrumentation. Thereafter, using the logged positions of BOP rams 36 and wear bushing 28, the proper position of adjustable hanger 14 is determined. Then, if necessary, adjustable hanger 14 is adjusted accordingly utilizing any of the methodologies described herein, and then landed inside wear bushing.

Figure 4:
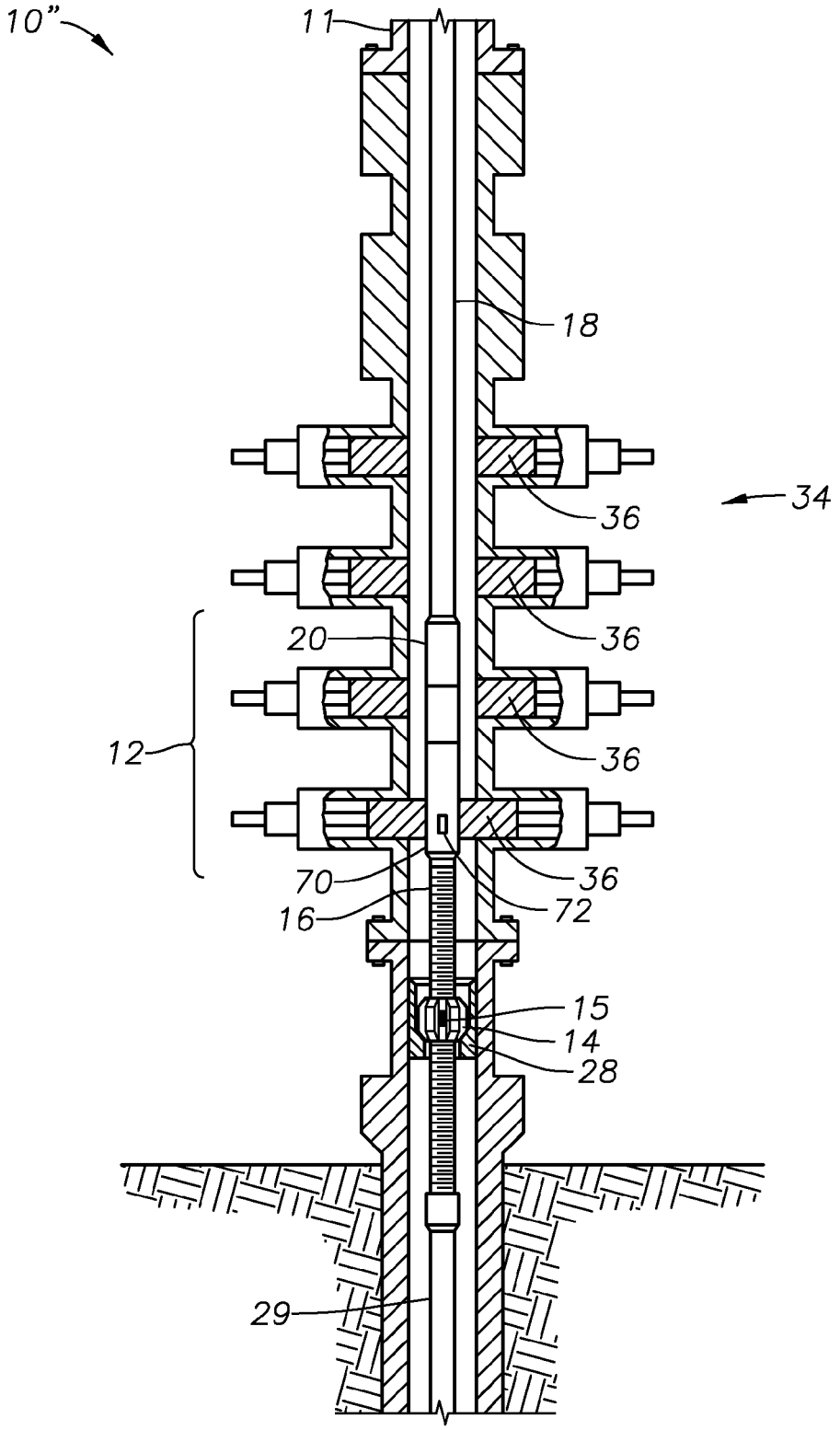

FIG. 4 illustrates yet another exemplary embodiment of the present invention, wherein an assembly 10" is landed on wear bushing 28. Assembly 10" comprises SSTT 12 and adjustable hanger 14 as previously described. However, a sensing joint 70 having one or more sensors 72 forms part of SSTT 12, and is used to determine the placement of SSTT 12 instead of the components described earlier. Sensing joint 70 may be positioned in place of the ram lock under valve/hydraulic section 20 or as part of the ram lock, as would be understood by those ordinarily skilled in the art having the benefit of this disclosure.

During operation of assembly 10", SSTT 12 is deployed into BOP 34 as part of the DST (as in previous embodiments), and adjustable hanger 14 is landed on wear bushing 28, as shown in FIG. 4. Then, one or more BOP rams 36 are closed on, around or adjacent to sensing joint 70 with sufficient pressure for detection, but not to inflict damage on sensing joint 70. The BOR ram 36 closed upon may be the ram that will be used to seal off the annulus, the bottom ram or the next one up, for example. Nevertheless, thereafter, sensing joint 70, utilizing the sensor 72, a CPU and the circuitry previously disclosed, determines if one or more BOP rams 36 contacted it and, if so, the location of the ram. Sensing joint 70 also determines were along sensing joint 70 BOP ram 36 contacted it, as well as whether BOP ram 36 completely missed sensing joint 70 and instead hit another part of SSTT 12. Once the correct position of SSTT 12 determined based upon the measurement data received from sensing joint 70, adjustable hanger 14 is adjusted accordingly.

Figure 5:
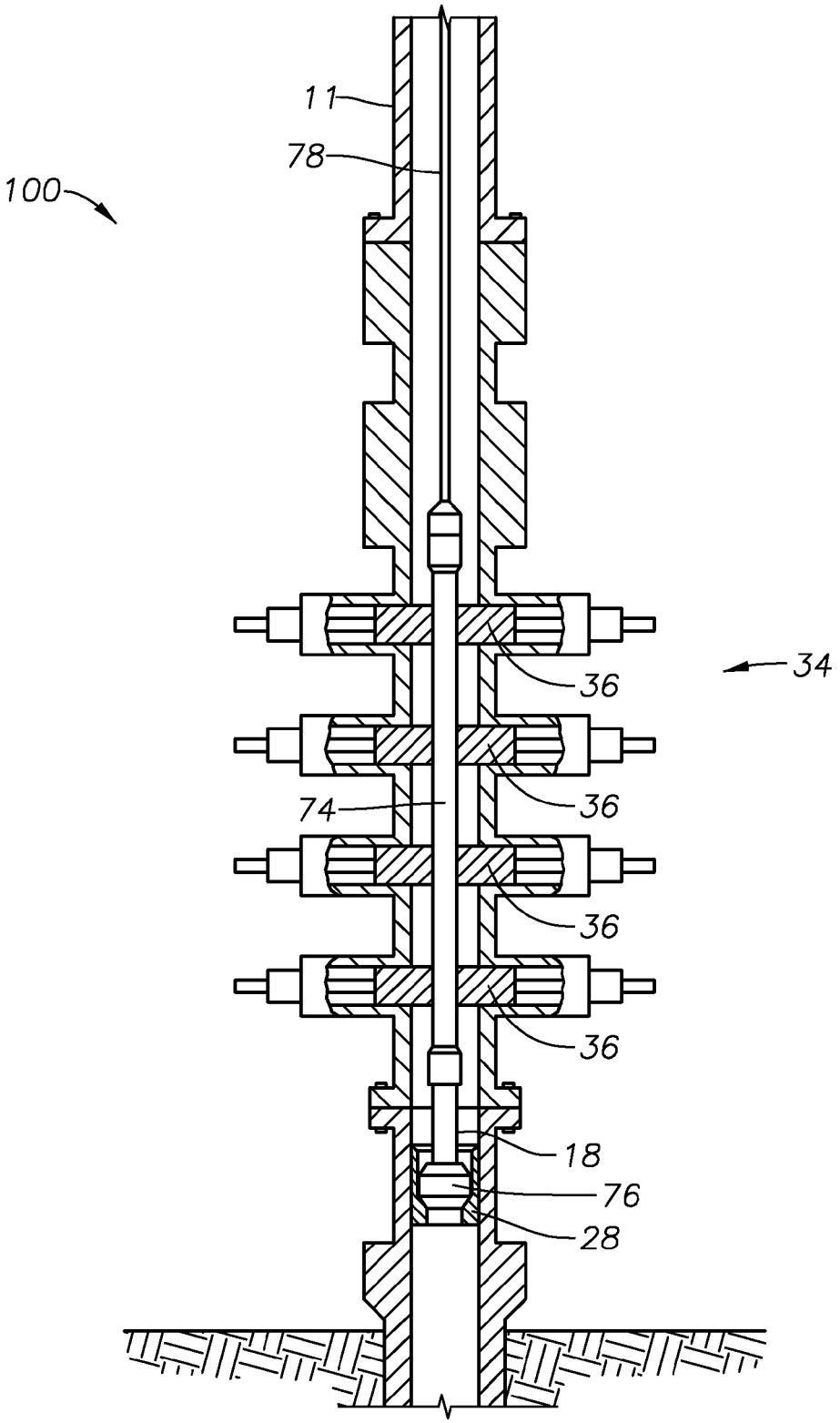

FIG. 5 illustrates another alternative exemplary embodiment of the present invention. Assembly 100, however, differs from the exemplary embodiments previously described in that it does not eliminate the dummy run. Rather, it is utilized to perform a dummy run. Assembly 100 comprises a joint 74 having a dummy hanger 76 positioned below it. In one embodiment, joint 74 is a painted joint. However, in an alternate embodiment, joint 74 may comprise distributed sensors as previously described herein. In addition, joint 74 may be comprised of aluminum or some other light weight material suitable for downhole use. The outer diameter of joint 74 matches the diameter of the real pipe that will be utilized during DST. Joint 74 is coupled to a flexible line 78 which is extended from a surface location. Line 78 may be any variety of lines such as, for example, wireline, slickline or sandline. Dummy hanger 76 is a "dummy" in that it is not an actual hanger, but rather a lightweight hanger replica so that it, along with joint 74, are light enough to be supported by line 78.

During operation, assembly 100 is deployed downhole on line 78. Once dummy hanger 76 is landed in wear bushing 28, one or more BOP rams 36 are closed around joint 74 sufficient for detection but not to damage joint 74. In embodiments utilizing a painted joint 74, BOP rams 36 would leave discernable marks along the painted exterior. In embodiments utilizing a distributed sensor along joint 74, BOP rams 36 would be detected, as previously described. Thereafter, joint 74 is retrieved from the well and the measurements are recorded. Then, SSTT 12 and fluted hanger 14 are adjusted and deployed. Accordingly, utilizing exemplary embodiments of assembly 100, the time it takes to execute a dummy run is greatly reduced due to the use of line 78 and/or a lightweight joint 74 and dummy hanger 76.

An exemplary embodiment of the present invention provides an assembly to determine placement of a subsea test tree ("SSTT") within a blow out preventer ("BOP"), the assembly comprising a tubing string, a SSTT positioned along the string, a first hanger positioned along the string, a sensing joint positioned along the string, the sensing joint comprising at least one sensor to sense a position of at least one BOP ram, and a second hanger positioned along the string. In another exemplary embodiment, the first hanger is positioned beneath the SSTT, the sensing joint is positioned beneath the first hanger, and the second hanger is positioned beneath the sensing joint. In yet another, the first hanger is axially adjustable along the string. In another, the first hanger comprises an internally threaded collar threadingly engaged to an externally threaded portion of the string. In yet another, the first hanger comprises a slip mechanism disposed to engage an exterior surface of the string.

In another exemplary embodiment, the second hanger is a temporary hanger comprising a retraction mechanism. In yet another, the assembly further comprises a mechanism to adjust the first hanger along the string. Yet another further comprises a CPU disposed to determine the axial position of the first hanger along the string.

An exemplary methodology of the present invention provides a method to determine placement of a subsea test tree ("SSTT") within a blow out preventer ("BOP"), the method comprising positioning a SSTT along a tubular string, positioning a first hanger along the string, positioning a sensing joint along the string, positioning a second hanger along the string, and determining a desired placement of the SSTT within the BOP. Another exemplary method comprises positioning the first hanger beneath the SSTT, positioning the sensing joint beneath the first hanger, and positioning the second hanger beneath the sensing joint. In another, determining the placement of the SSTT within the BOP further comprises landing the second hanger adjacent the BOP, closing at least one BOP ram adjacent the sensing joint, detecting a position of the at least one BOP ram, and adjusting a position of the first hanger based on the position of the at least one BOP ram, thereby determining the placement of the SSTT within the BOP.

In yet another, determining the placement of the SSTT within the BOP further comprises detecting a position of at least one BOP ram using the sensing joint and adjusting the first hanger in response to the detected position of the at least one BOP ram, thereby determining the placement of the SSTT within the BOP. Another exemplary method further comprises disengaging the second hanger, passing the second hanger through a landing mechanism, and landing the first hanger on the landing mechanism.

Another exemplary methodology of the present invention provides a method to determine placement of a subsea test tree ("SSTT") within a blow out preventer ("BOP"), the method comprising deploying an assembly within a BOP on a first run-in trip, the assembly comprising the SSTT and a sensor, detecting a location of at least one BOP ram using the sensor, and determining a desired placement of the SSTT within the BOP based upon the detected location of the at least one BOP ram. Another exemplary method further comprises adjusting the position of a hanger relative to the SSTT based upon the detected location of the at least one BOP ram. Another further comprises conducting drillstem tests during the first run-in trip. In another, the method is conducted in a single trip downhole.

Another exemplary methodology of the present invention provides a method to determine placement of a subsea test tree ("SSTT") within a blow out preventer ("BOP"), the method comprising determining the placement of the SSTT within the BOP without the use of a dummy run. In another, the determination of the placement of the SSTT is accomplished in a single run-in trip. Yet another exemplary methodology further comprises deploying an assembly within a BOP, the assembly comprising the SSTT and a hanger, detecting a location of at least one BOP ram, and determining a desired placement of the SSTT within the BOP based upon the detected location. Another further comprises adjusting the position of the hanger relative to the SSTT based upon the detected location of the at least one BOP ram. In yet another, determining the placement of the SSTT within the BOP comprises comparing a predicted distance between the hanger and the SSTT to a true distance between the hanger and the SSTT, and adjusting the position of the hanger relative to the SSTT to match the true distance.

Another exemplary embodiment of the present invention provides an assembly to determine placement of a subsea test tree ("SSTT") within a blow out preventer ("BOP"), the assembly comprising a tubular string, a SSTT positioned along the string, a hanger positioned along the string, and at least one sensor positioned along the string, the at least one sensor disposed to log a position of at least one BOP ram and a hang off location for the hanger. In another, the at least one sensor comprises a logging tool disposed on the string below the hanger. In yet another, the at least one sensor is disposed between the SSTT and the hanger. In another, the hanger is positioned beneath the SSTT, and the sensor is positioned beneath the hanger. In yet another, the hanger is axially adjustable along the string. Another exemplary embodiment further comprises a mechanism to adjust the axial position of the hanger along the string relative to the SSTT. Another further comprises a CPU disposed to determine an adjustment of the first hanger along the string.

An exemplary methodology of the present invention provides a method to determine placement of a subsea test tree ("SSTT") within a blow out preventer ("BOP"), the method comprising positioning a SSTT along a tubular string, positioning a hanger along the string, positioning a logging tool along the string, and determining a desired placement of the SSTT within the BOP. Another further comprises positioning the hanger beneath the SSTT and positioning the logging tool beneath the hanger. In another, determining the placement of the SSTT within the BOP further comprises passing the logging tool through the BOP and past a hang off location for the hanger, logging a position of at least one BOP ram and the hang off location for the hanger, and adjusting the hanger based on the logged positions, thereby positioning the SSTT within the BOP. In yet another, positioning the SSTT within the BOP further comprises detecting a position of at least one BOP ram using the logging tool and adjusting the hanger in response to the detected position of the at least one BOP ram, thereby positioning the SSTT within the BOP.

Another exemplary methodology of the present invention provides a method to determine placement of a subsea test tree ("SSTT") within a blow out preventer ("BOP"), the method comprising deploying an assembly comprising the SSTT and a logging tool, logging a position of at least one BOP ram using the logging tool, and determining a desired placement of the SSTT within the BOP based upon the logged location of the at least one BOP ram. Another further comprises adjusting the relative spacing between the SSTT and a hanger based upon the logged position of the at least one BOP ram. Yet another further comprises performing at least one drillstem test while the SSTT assembly is deployed. Yet another further comprises logging a position of a hang off location, wherein the determination of the placement of the SSTT is also based upon the logged position of the hang off location.

Another exemplary embodiment of the present invention provides an assembly to determine placement of a subsea test tree ("SSTT") within a blow out preventer ("BOP"), the assembly comprising a tubular string, a SSTT positioned along the string, the SSTT comprising a sensing joint to sense a position of at least one BOP ram, and a hanger positioned along the string. In another, the hanger is an axially adjustable hanger. Yet another further comprises a mechanism to adjust the hanger along the string. In yet another, the axially adjustable hanger comprises an internally threaded collar threadingly engaged to an externally threaded portion of the string. In yet another, the axially adjustable hanger comprises a slip mechanism disposed to engage an exterior surface of the string. Another further comprises a CPU disposed to determine the axial position of the hanger along the string.

Another exemplary methodology of the present invention provides a method to determine placement of a subsea test tree ("SSTT") within a blow out preventer ("BOP"), the method comprising supporting a SSTT along a tubing string, the SSTT comprising a sensing joint, positioning a hanger along the string, and determining a desired placement of the SSTT within the BOP. In another, determining the placement of the SSTT within the BOP further comprises landing the hanger adjacent the BOP, activating at least one BOP ram adjacent the sensing joint, detecting a position of the at least one BOP ram, and adjusting a position of the hanger along the tubing string based on the position of the at least one BOP ram. In another, determining the placement of the SSTT within the BOP further comprises detecting a position of at least one BOP ram using the sensing joint, and adjusting the axial position of the hanger along the tubing string in response to the detected position of the at least one BOP ram.

Another exemplary methodology of the present invention provides a method to determine placement of a subsea test tree ("SSTT") within a blow out preventer ("BOP"), the method comprising deploying an assembly comprising the SSTT and at least one sensor, detecting a location of at least one BOP ram using the sensor, and determining a desired placement of the SSTT within the BOP based upon the detected location of the at least one BOP ram. Another further comprises adjusting the axial position of a hanger along a tubing string based upon the detected location of the at least one BOP ram. Yet another further comprises conducing at least one drillstem test while the SSTT is deployed.

Another exemplary embodiment of the present invention provides an assembly to determine placement of a subsea test tree ("SSTT") within a blow out preventer ("BOP"), the assembly comprising a flexible line, a tubular joint supported by the flexible line, and a dummy hanger supported beneath the joint. In yet another, the line is one of a wireline, slickline or sandline. In another, the joint is a painted joint. In yet another, the joint comprises a sensor to sense a location of at least one BOP ram.

Another exemplary methodology of the present invention provides a method to determine placement of a subsea test tree ("SSTT") within a blow out preventer ("BOP"), the method comprising deploying a flexible line from a surface location, supporting a tubular joint on the line, supporting a dummy hanger below the tubular joint, and determining a desired placement of the SSTT within the BOP. In another, deploying the line further comprises deploying one of a wireline, slickline or sandline in a riser. In yet another, supporting the tubular joint further comprises positioning a painted joint within a BOP. In another, supporting the tubular joint further comprises positioning a joint comprising a sensor to sense a location of at least one BOP ram. In yet another, determining the placement of the SSTT within the BOP further comprises landing the dummy hanger in on landing mechanism adjacent the BOP, activating at least one BOP ram, detecting a position of the at least one activated BOP ram, retrieving the joint to a surface location, and adjusting the relative spacing between the SSTT and a fluted hanger based on the position of the at least one activated BOP ram.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Although various embodiments and methodologies have been shown and described, the invention is not limited to such embodiments and methodologies and will be understood to include all modifications and variations as would be apparent to one skilled in the art. For example, instead of the fluted hanger described herein, other hangers that allow fluid communication could be utilized as well, as understood by ordinarily skilled persons having the benefit of this disclosure. Therefore, it should be understood that the invention is not intended to be limited to the particular forms disclosed. Rather, the intention is to cover all modifications, equivalents and alternatives falling within the spirit and scope of the invention as defined by the appended claims.

What we claim is:

1. An assembly to determine placement of a subsea test tree ("SSTT") within a blow out preventer ("BOP"), the assembly comprising:

a tubing string;

a SSTT positioned on the string;

a first hanger positioned on the string; and a sensing mechanism having a sensor to sense a location of at least one BOP ram along the sensing mechanism, the sensing mechanism being positioned on the string to determine placement of the SSTT within a BOP.

2. An assembly as defined in claim 1, wherein:

the assembly further comprises a second hanger positioned along the string; and the sensing mechanism is a sensing joint comprising a sensor module extending along a length of the sensing joint.

3. An assembly as defined in claim 2, wherein the first hanger is positioned beneath the SSTT, the sensing joint is positioned beneath the first hanger, and the second hanger is positioned beneath the sensing joint.

4. An assembly as defined in claim 2, wherein the second hanger is a temporary hanger comprising a retraction mechanism.

5. An assembly as defined in claim 1, wherein the first hanger is axially adjustable along the string.

6. An assembly as defined in claim 5, wherein the first hanger comprises an internally threaded collar threadingly engaged to an externally threaded portion of the string.

7. An assembly as defined in claim 5, wherein the first hanger comprises a slip mechanism disposed to engage an exterior surface of the string.

8. An assembly as defined in claim 5, further comprising a mechanism to adjust the first hanger along the string relative to the SSTT.

9. An assembly as defined in claim 1, further comprising a CPU disposed to determine an axial position of the first hanger along the string.

10. An assembly as defined in claim 1, wherein the sensing mechanism is a logging tool disposed on the string, the logging tool being disposed to log a position of the at least one BOP ram and a hang off location for the first hanger.

11. An assembly as defined in claim 10, wherein the logging tool is positioned below the first hanger.

12. An assembly as defined in claim 1, wherein the sensing mechanism is a sensing joint forming part of the SSTT.

13. An assembly as defined in claim 12, wherein the first hanger is positioned beneath the SSTT.

14. A method to determine placement of a subsea test tree ("SSTT") within a blow out preventer ("BOP"), the method comprising:

deploying an assembly comprising a SSTT, first hanger, and a sensing mechanism positioned on a tubing string, the sensing mechanism having a sensor;

using the sensor, detecting a location of at least one BOP ram along the sensing mechanism; and determining a placement of the SSTT within the BOP based upon the detected location of the at least one BOP ram.

15. A method as defined in claim 14, wherein:

the sensing mechanism is a sensing joint and the sensor extends along a length of the sensing joint; and deploying the assembly further comprises:

positioning the first hanger beneath the SSTT;

positioning the sensing joint beneath the first hanger; and positioning a second hanger beneath the sensing joint.

16. A method as defined in claim 15, wherein determining the placement of the SSTT within the BOP further comprises:

landing the second hanger adjacent the BOP;

closing at least one BOP ram adjacent the sensing joint;

detecting a position of the at least one BOP ram; and adjusting a position of the first hanger based on the position of the at least one BOP ram, thereby determining the placement of the SSTT within the BOP.

17. A method as defined in claim 15, wherein determining the placement of the SSTT within the BOP further comprises:

detecting a position of at least one BOP ram using the sensing joint; and adjusting the first hanger in response to the detected position of the at least one BOP ram, thereby determining the placement of the SSTT within the BOP.

18. A method as defined in claim 17, further comprising:

disengaging the second hanger;

passing the second hanger through a landing mechanism; and landing the first hanger on the landing mechanism.

19. A method as defined in claim 14, further comprising adjusting the position of the first hanger relative to the SSTT based upon the detected location of the at least one BOP ram.

20. A method as defined in claim 14, wherein the method is conducted in a single downhole trip.

21. A method as defined in claim 14, wherein:

the sensing mechanism is a logging tool; and deploying the assembly further comprises:

positioning the first hanger beneath the SSTT; and positioning the logging tool beneath the first hanger.

22. A method as defined in claim 21, wherein determining the placement of the SSTT within the BOP further comprises:

passing the logging tool through the BOP and past a hang off location for the first hanger;

logging a position of at least one BOP ram and the hang off location for the first hanger; and adjusting the first hanger based on the logged positions, therthy positioning the SSTT within the BOP.

23. A method as defined in claim 21, wherein positioning the SSTT within the BOP further comprises:

detecting a position of at least one BOP ram using the logging tool; and adjusting the first hanger in response to the detected position of the at least one BOP ram, thereby positioning the SSTT within the BOP.

24. A method as defined in claim 14, wherein:

the sensing mechanism is a sensing joint forming part of the SSTT; and deploying the assembly further comprises positioning the first hanger beneath the SSTT.

25. A method as defined in claim 24, wherein determining the placement of the SSTT within the BOP further comprises:

landing the first hanger adjacent the BOP;

activating at least one BOP ram adjacent the sensing joint;

detecting a position of the at least one BOP ram; and adjusting a position of the first hanger along the string based on the position of the at least one BOP rain.

26. A method as defined in claim 24, wherein determining the placement of the SSTT within the BOP further comprises:

detecting a position of at least one BOP ram using the sensing joint; and adjusting the axial position of the first hanger along the tubing string in response to the detected position of the at least one BOP ram.

27. A method as defined in claim 14, further comprising conducting a drillstem test while the SSTT is deployed.

28. A method to determine placement of a subsea test tree ("SSTT") within a blow out preventer ("BOP"), the method comprising:

deploying an assembly within a BOP, the assembly comprising an SSTT and a hanger;

detecting a location of at least one BOP ram; and determining placement of the SSTT within the BOP based upon the detected location, wherein the determination of the placement of the SSTT and a drill string test are conducted in a single run-in trip.

29. A method as defined in claim 28, further comprising adjusting the position of the hanger relative to the SSTT based upon the detected location of the at least one BOP ram.

30. A method as defined in claim 28, wherein determining the placement of the SSTT within the BOP comprises:

comparing a predicted distance between the hanger and the SSTT to a true distance between the hanger and the SSTT; and adjusting the position of the hanger relative to the SSTT to match the true distance.

31. An assembly to determine placement of a subsea test tree ("SSTT") within a blow out preventer ("BOP"), the assembly comprising:

a flexible line;

a tubular joint supported by the flexible line, wherein the tubular joint is used to determine placement of the SSTT within the BOP; and a dummy hanger supported beneath the tubular joint.

32. An assembly as defined in claim 31, wherein the line is one of a wireline, slickline or sandline.

33. An assembly as defined in claim 31, wherein the tubular joint is a painted joint.

34. An assembly as defined in claim 31, wherein the tubular joint comprises a sensor to sense a location of at least one BOP ram.

35. A method to determine placement of a subsea test tree ("SSTT") within a blow out preventer ("BOP"), the method comprising:

deploying a flexible line from a surface location;

supporting a tubular joint on the line;

supporting a dummy hanger below the tubular joint; and determining a desired placement of the SSTT within the BOP.

36. A method as defined in claim 35, wherein deploying the line further comprises deploying one of a wireline, slickline or sandline in a riser.

37. A method as defined in claim 35, wherein supporting the tubular joint further comprises positioning a painted joint within a BOP.

38. A method as defined in claim 35, wherein supporting the tubular joint further comprises positioning a joint comprising a sensor to sense a location of at least one BOP ram.

39. A method as defined in claim 35, wherein determining the placement of the SSTT within the BOP further comprises:

landing the dummy hanger in a landing mechanism adjacent the BOP;

activating at least one BOP ram;

detecting a position of the at least one activated BOP ram;

retrieving the tubular joint to a surface location; and adjusting the relative spacing between the SSTT and a fluted hanger based on the position of the at least one activated BOP ram.

* * * * *